US007793601B2

(12) United States Patent
Davison et al.

(10) Patent No.: US 7,793,601 B2
(45) Date of Patent: Sep. 14, 2010

(54) SIDE FEED/CENTRE ASH DUMP SYSTEM

(76) Inventors: Kenneth Davison, 10283 Monte Bella Road, Lake Country, British Columbia (CA) V4V 1K7; Neal Stroulger, 4336 Stevenson Road, Kamloops, British Columbia (CA) V2H 1S8

( * ) Notice: Subject to any disclaimer, the term of this patent is extended or adjusted under 35 U.S.C. 154(b) by 371 days.

(21) Appl. No.: 11/285,145

(22) Filed: Nov. 23, 2005

(65) Prior Publication Data

US 2006/0107595 A1 May 25, 2006

Related U.S. Application Data

(60) Provisional application No. 60/629,972, filed on Nov. 23, 2004.

(51) Int. Cl.
*F23G 5/12* (2006.01)

(52) U.S. Cl. ..... 110/229; 110/165 R

(58) Field of Classification Search ..... 110/211, 110/210, 213, 212, 214, 229, 165 R
See application file for complete search history.

(56) References Cited

U.S. PATENT DOCUMENTS

| | | | | | |
|---|---|---|---|---|---|
| 733,374 | A | * | 7/1903 | Daley | 110/289 |
| 1,675,548 | A | * | 7/1928 | Hall et al. | 110/287 |
| 1,956,939 | A | * | 5/1934 | Wynn, Jr. | 110/287 |
| 2,032,402 | A | | 3/1936 | Colby et al. | |
| 2,063,630 | A | | 12/1936 | Schilling | |
| 2,088,679 | A | | 8/1937 | Yamazaki et al. | |
| 2,171,538 | A | | 9/1939 | Black et al. | |
| 3,267,890 | A | | 8/1966 | Zinn et al. | |
| 3,543,700 | A | | 12/1970 | Balgas et al. | |
| 3,595,181 | A | | 7/1971 | Anderson et al. | |
| 3,610,179 | A | * | 10/1971 | Shaw et al. | 110/214 |
| 3,747,542 | A | | 7/1973 | Ruohola et al. | |
| 3,774,555 | A | | 11/1973 | Turner | |
| 3,780,674 | A | | 12/1973 | Liu | |
| 3,808,986 | A | | 5/1974 | Logdon | |
| 3,958,920 | A | | 5/1976 | Anderson | |
| 4,003,683 | A | | 1/1977 | Powell, Jr. et al. | |
| 4,013,023 | A | | 3/1977 | Lombana et al. | |
| 4,027,602 | A | | 6/1977 | Mott | |
| 4,052,173 | A | | 10/1977 | Schulz | |

(Continued)

FOREIGN PATENT DOCUMENTS

| | | |
|---|---|---|
| GB | 17687 | 1/1915 |

*Primary Examiner*—Kenneth B Rinehart
(74) *Attorney, Agent, or Firm*—C. Larry Kyle; Nexus Law Group LLP

(57) ABSTRACT

An apparatus for gasifying solid organic fuel includes a refractory-lined oxidation chamber, fuel storage, a transfer connecting the fuel storage with an inlet into the oxidation chamber for transferring in an upwardly inclined direction the solid fuel from the fuel storage into the inlet to form an upwardly mounded fuel bed. An oxidant is supplied into the fuel bed to gasify the organic materials in the fuel to produce a gaseous effluent from the fuel bed, thereby leaving a residue of the fuel. The residue drops through an opening under the oxidation chamber onto a residue removal transfer. The oxidant is supplied through a plurality of perforated air distribution members extending across the fuel bed cavity in the oxidation chamber so as to introduce air into the interior of the fuel bed to thereby promote evenly distributed gasification, evenly distributed through the fuel bed.

8 Claims, 15 Drawing Sheets

U.S. PATENT DOCUMENTS

| | | | | |
|---|---|---|---|---|
| 4,184,436 | A | | 1/1980 | Palm et al. |
| 4,213,404 | A | | 7/1980 | Spaulding |
| 4,280,417 | A | | 7/1981 | Alexandersson |
| 4,311,102 | A | | 1/1982 | Kolze et al. |
| 4,312,278 | A | | 1/1982 | Smith et al. |
| 4,334,484 | A | | 6/1982 | Payne et al. |
| 4,366,802 | A | | 1/1983 | Goodine |
| 4,378,208 | A | | 3/1983 | Payne et al. |
| 4,389,978 | A | * | 6/1983 | Northcote ..... 122/4 D |
| 4,430,948 | A | | 2/1984 | Schafer et al. |
| 4,438,705 | A | * | 3/1984 | Basic, Sr. ..... 110/235 |
| 4,474,121 | A | | 10/1984 | Lewis |
| 4,483,256 | A | | 11/1984 | Brashear |
| 4,531,462 | A | | 7/1985 | Payne |
| 4,565,137 | A | | 1/1986 | Wright |
| 4,574,711 | A | | 3/1986 | Christian |
| 4,593,629 | A | | 6/1986 | Pedersen et al. |
| 4,848,249 | A | | 7/1989 | LePori et al. |
| 4,870,910 | A | | 10/1989 | Wright et al. |
| 4,971,599 | A | | 11/1990 | Cordell et al. |
| 5,026,403 | A | | 6/1991 | Michel-Kim |
| 5,028,241 | A | | 7/1991 | Kooiman et al. |
| 5,095,829 | A | | 3/1992 | Nevels |
| 5,138,957 | A | | 8/1992 | Morey et al. |
| 5,193,468 | A | | 3/1993 | McRae |
| 5,383,446 | A | | 1/1995 | Whitfield |
| 5,573,559 | A | | 11/1996 | Hilliard et al. |
| 5,620,488 | A | | 4/1997 | Hirayama et al. |
| 5,823,122 | A | | 10/1998 | Chronowski et al. |
| 5,858,033 | A | | 1/1999 | Hirayama et al. |
| 6,381,963 | B1 | | 5/2002 | Graham |
| 6,871,603 | B2 | | 3/2005 | Maxwell |
| 2002/0010382 | A1 | | 1/2002 | Taylor |
| 2003/0110994 | A1 | | 6/2003 | Lissianski et al. |
| 2003/0177963 | A1 | | 9/2003 | Maxwell |
| 2003/0221597 | A1 | | 12/2003 | Barba |
| 2004/0107638 | A1 | | 6/2004 | Graham et al. |
| 2004/0261670 | A1 | | 12/2004 | Dueck et al. |
| 2005/0109603 | A1 | | 5/2005 | Graham |

* cited by examiner

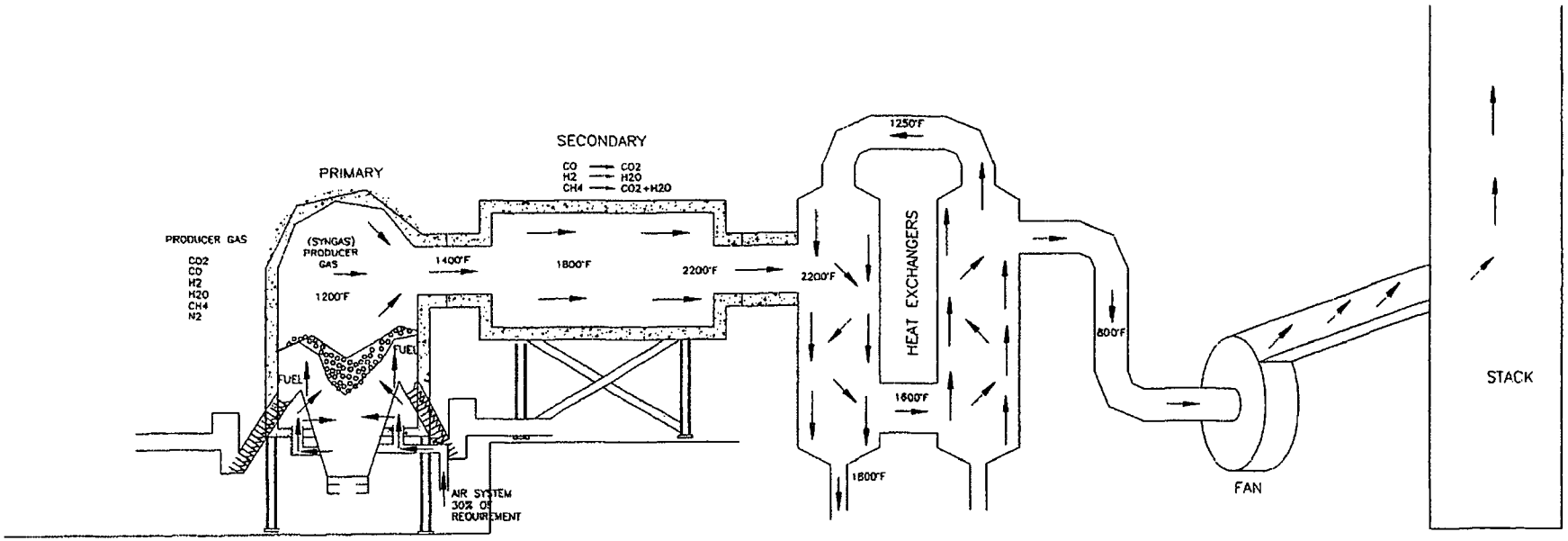
Figure 5. Gasifier to Heat Exchanger

SIDE FEED/CENTRE ASH DUMP SYSTEM

CROSS REFERENCE TO RELATED APPLICATION

This application claims priority from U.S. Provisional Patent Application No. 60/629,972 filed Nov. 23, 2004 entitled Side Feed/Centre Ash Dump System.

FIELD OF THE INVENTION

This invention relates to a method and apparatus for gasifying solid organic materials to convert the chemical energy stored in such materials to thermal energy. More particularly, this invention relates to a method and apparatus for gasifying low or high ash biomass materials. The high temperature gases produced by the practice of the invention can be utilized to advantage, for example, as the thermal energy source for conventional heat exchange equipment such as boilers.

BACKGROUND OF THE INVENTION

On many conventional gasification systems there has been difficulty in fuel delivery and ash removal from the gasifier primary chambers. This has been especially apparent on high ash fuels as well as fuels with low ash melting or fusion temperatures.

It has been recognized that many industrial and agricultural solid organic by-products, such as wood chips, agricultural waste, and other biomass material, contain large amounts of chemical energy. The substantial increases in the cost of traditional fuels, such as natural gas, have provided substantial economic incentive to try to develop effective and efficient techniques for recovering the energy in these organic by-products, energy that traditionally was not recovered to any substantial extent. Such organic materials, which are frequently referred to as "biomass" materials, are now successfully utilized to some extent as fuel in some very large industrial systems, for example, in firing the recovery boiler in a pulp or paper mill. However, the higher capital cost which has heretofore been associated with biomass energy recovery systems has precluded their successful use in small or even medium size energy recovery systems. Energy recovery systems, of the size from about 500,000 to 40,000,000 BTU/Hr., are used in schools, nursing homes, and small industrial and commercial establishments. Among the U.S. patents that have been issued on inventions relating to the recovery of energy from wood chips or similar organic materials are U.S. Pat. No. 4,184,436, to Palm, et al.; U.S. Pat. No. 4,312,278, to Smith, et al.; U.S. Pat. No. 4,366,802, to Goodine; U.S. Pat. No. 4,321,877, to Schmidt, et al.; and U.S. Pat. No. 4,430,948, to Ekenberg. However, it is not known that any of the inventions described in these patents have been successfully adapted to recovering biomass energy on a cost-effective basis in small and medium size energy recovery system. Dealing with high ash fuels has proved especially difficult for many of these processes.

SUMMARY OF THE INVENTION

In summary, the apparatus according to the present invention for gasifying solid fuel including solid organic materials includes a primary oxidation chamber advantageously having an inner surface lined with a refractory material to promote catalytic oxidation of the solid organic materials. The primary oxidation chamber has a bottom portion and a converging upper portion, the latter to facilitate mixing of gaseous material in the chamber. The bottom portion has an inlet opening for infeed of fuel.

The apparatus further includes means for storing the solid organic materials; transfer passage means connecting the means for storing with the inlet opening for transferring the solid fuel from the means for storing through the inlet opening into the primary oxidation chamber to form a fuel bed of solid fuel including the organic material in the primary oxidation chamber. A means for supplying an oxidant into the primary oxidation chamber supplies a first oxidant to gasify the solid organic materials to produce gasified organic materials including a first gaseous effluent, and thereby leaving a residue. The means for supplying the oxidant may have a plurality of air distribution members extending across said bottom portion and adjacent to fuel driven into said bed through the inlet opening of the primary oxidation chamber so as to introduce air into the interior of the fuel bed to thereby promote evenly distributed gasification, evenly distributed through said fuel bed.

The plurality of air distribution members include perforated members extending across a cavity of the bottom portion so as to promote infiltration of the first oxidant throughout the fuel bed.

The bottom portion of the primary oxidation chamber advantageously has mounted thereunder means for the removal of the residue of the fuel, that is, the materials such as ash left in the primary oxidation chamber after the solid organic materials have been gasified. Further advantageously, a further means is disposed within the primary oxidation chamber for establishing a gaseous mixing flow path within the primary oxidation chamber for enhancing the oxidation of the mass of the solid organic materials to produce the first gaseous effluent. Cooperating with the primary oxidation chamber is a means for removing the first gaseous effluent from the primary oxidation chamber.

In a preferred embodiment, the means for supplying an oxidant into the primary oxidation chamber adds the oxidant at a predetermined rate to maintain a volume or flow rate of the first gaseous effluent in the primary oxidation chamber. In a preferred embodiment the predetermined flow rate of oxidant is a relatively gentle flow rate so as to not blow or otherwise end-up suspending particulate matter from the gasifying solid organic materials into the first gaseous effluent. A secondary oxidation chamber may be provided cooperating in fluid communication with the primary oxidation chamber. The secondary oxidation chamber receives the first gaseous effluent from the means for removing the first gaseous effluent from the primary oxidation chamber. A means for supplying a second oxidant to the first gaseous effluent in the secondary oxidation chamber supplies a second oxidant into the secondary oxidation chamber to produce a second gaseous effluent. The second oxidant oxidizes the first gaseous effluent in the secondary oxidation chamber to thereby release further energy from the gasified effluent, preferably in the form of recoverable heat energy which may be used in a heat exchanger for example. A means for withdrawing the second gaseous effluent from the secondary oxidation chamber removes the second gaseous effluent.

In one preferred embodiment, the means for supplying an oxidant to the primary oxidation chamber may include a first air blower mounted to the primary oxidation chamber, and the means for supplying an oxidant to the secondary oxidation chamber may include a second air blower mounted to the secondary oxidation chamber.

The transfer means for transferring the solid organic materials from the means for storing into the primary oxidation chamber may include, without intending to be limiting, a screw-type feeder or hydraulic ram feeder. The transfer passage means may include a fuel removal means for removing the fuel from the storage means and for transferring the fuel to the feeder adjacent the inlet opening of the primary oxidation chamber. The feeders may advantageously include an upwardly inclined passage extending into the inlet opening of the primary oxidation chamber, upwardly inclined so that fuel is forced into the primary oxidation chamber in an upwardly inclined direction. This drives un-oxidized fuel, that is, new fuel upwardly into the bed of fuel being gasified in the primary oxidation chamber so as to drive the fuel toward the surface of the bed which is maintained above the level of the fuel infeed or inlet opening. The residue or ash is left to migrate downwardly below the new fuel and surface of the bed so as to migrate to the bottom of the bed for removal therefrom.

The fuel removal means may include a first screw-type feeder which may include a helical screw or auger mounted inside a passage which may lead to either a second feeder such as a screw-type feeder or a hydraulic ram feeder feeding into the inlet opening, both serially disposed with respect of the first screw-type feeder. The first screw-type feeder may alternatively be a walking-floor feeder wherein a reciprocating rack having upstanding lugs, corrugations, etc slides reciprocally relative to a fixed floor so as to urge fuel piled on the floor in a direction towards the second feeder.

Advantageously, the means for removing the first gaseous effluent may include an insulated exit duct connecting the primary oxidation chamber to the secondary oxidation chamber permitting the secondary oxidation chamber to receive the first gaseous effluent from the primary oxidation chamber, wherein the insulated exit duct has a restricted entry portion to prevent the passage of a flame in the primary oxidation chamber into the secondary oxidation chamber, and wherein the restricted entry portion is disposed within the primary oxidation chamber.

Further advantageously, the primary oxidation chamber may have the shape of a generally vertically extending cylinder or box having a vertically extending longitudinal axis and the converging upper portion at one end thereof. The primary oxidation chamber may maintain an angled or domed roof.

In one embodiment the means for removal of the solid residue includes a continuous, such as auger, or intermittent, such as a walking floor, ash removal system positioned at the bottom of the primary oxidation chamber adjacent to the air distribution member.

The means for supplying an oxidant into the primary oxidation chamber may further include an air blower mounted to the primary oxidation chamber, the air blower supplying air to the air distribution member. The means for supplying an oxidant into the primary oxidation chamber may further include a means for adding a portion of the first oxidant into the transfer passage means so as to intersperse with the solid organic materials being transferred, and means for supplying a second portion of the first oxidant into the primary oxidation chamber at least one location above the mass of the solid organic materials to enhance gasification of the solid organic materials.

According to one aspect of the invention there is provided a method for gasifying solid organic materials to produce finished gaseous effluent and solid residue, said method comprising the steps of: providing a source of supply of solid organic materials; providing a primary oxidation chamber having a bottom portion and a converging upper portion to facilitate mixing of gaseous material in said chamber; introducing solid organic materials from said source of supply into said primary oxidation chamber to provide a mass of said solid organic materials in said primary oxidation chamber; heating said mass of organic materials in said primary oxidation chamber; adding an oxidant to said primary oxidation chamber to gasify said heated mass of solid organic materials in said primary oxidation chamber and initiate a flow of gaseous effluent within said primary oxidation chamber; establishing a gaseous flow path within said primary oxidation chamber whereby mixing and then advancing said gaseous effluent flow in a direction outward from said primary oxidation chamber; and transferring said solid residue out of said primary oxidation chamber.

The invention also provides an apparatus for gasifying solid organic materials comprising: a primary oxidation chamber having an inner surface lined with a refractory to promote oxidation of said solid organic materials, said primary oxidation chamber having a bottom portion and a converging upper portion to facilitate mixing of gaseous material in said chamber, and an inlet opening provided through said bottom or side portion; means for storing said solid organic materials; transfer passage means connecting said means for storing with said inlet opening for transferring said solid organic materials from said means for storing through said inlet opening to said primary oxidation chamber to form a mass of solid organic materials in said primary oxidation chamber; means for supplying an oxidant into said primary oxidation chamber to gasify said solid organic materials to produce gasified organic materials including a first gaseous effluent and solid residue, said means for supplying said oxidant having an air distribution member surrounding said transfer passages means adjacent to said inlet opening of said primary oxidation chamber to introduce air into the interior of said mass of solid organic materials in said primary oxidation chamber; means provided in said bottom of said primary oxidation chamber in the middle of the chamber for the removal of said solid residue of said solid organic materials from said primary oxidation chamber after said solid organic materials have been gasified; means disposed within said primary oxidation chamber for establishing a gaseous flow path within said primary oxidation chamber for enhancing the oxidation of said mass of solid organic materials to produce said first gaseous effluent; and means for removing said first gaseous effluent from said primary oxidation chamber.

In accordance with the present invention, an apparatus is provided for the recovery of energy from biomass materials by the gasification of such materials.

The method and apparatus according to the present invention can be utilized on a cost-effective basis, due to the relatively low capital cost of the apparatus, to cleanly and efficiently recover energy at medium rates of recovery, and even at low rates or recovery, for example, approximately 100,000 BTU/Hr., rates which typically are those needed in home heating units, and larger units for commercial applications. The apparatus according to this invention utilizes a primary oxidation chamber with a converging upper portion to facilitate even mixing where the biomass feed stock is partially oxidized slowly in a process in which it first evaporates the volatiles and moisture and then reacts the resulting char preferably in a deficiency of oxygen, producing a medium temperature combustible effluent which can be oxidized in a secondary oxidation chamber or the partially oxidized combustible effluent can be use as a fuel for mechanical engines (such as turbines), or processed to create alternate fuels such as Ethanol and Methanol. If completely oxidized in the secondary chamber the high temperature effluent from the secondary oxidation chamber can be utilized as a thermal energy source, (for example, in an otherwise conventional water tube boiler as a substitute for the effluent from the fuel oil or gas burner that is normally utilized in conjunction with a boiler of such type.). During normal operation, the biomass feedstock is mechanically fed to the primary oxidation chamber from a storage hopper by means of a single or multiple screw feeding system, preferably automatically in response to the demand for fuel from the system. The converging primary oxidation chamber is provided with a hydraulic or screw conveyor system for removing ash and non-combustible contaminants, such as sand, dirt, stones and rocks from the chamber.

The biomass oxidation method and apparatus according to the present invention can be utilized to particular advantage in small and medium sized industry applications and where biomass feed stocks are plentiful and inexpensive as a result of the agricultural and/or forest-based business activities that are of frequently conducted in such regions.

Accordingly, the present invention provides an improved method and apparatus for producing energy by gasification of organic materials.

More particularly, the present invention provides an improved method apparatus for efficiently producing energy at relatively low rates by the gasification of organic materials.

Suitably the method is a continuous method, wherein the solid organic materials are transferred to said primary oxidation chamber to maintain a mass of said solid organic materials in said primary oxidation chamber, wherein said oxidant is continuously added to said primary oxidation chamber to continuously gasify solid organic materials in said mass, and wherein said gasified solid organic materials are continuously transferred out of said gasification chamber. Desirably said gasified solid organic materials are continuously transferred to a device to recover the thermal energy therein. Suitably the method further comprises the steps of controlling the rate at which said solid organic materials are transferred to said primary oxidation chamber to maintain a substantially constant mass of said solid organic materials in said primary oxidation chamber. Desirably said oxidant is added to said primary oxidation chamber at a rate which is insufficient to fully oxidize said solid organic materials, said method further comprising the steps of: providing a secondary oxidation chamber for receiving said gasified solid organic materials that are transferred out of said primary oxidation chamber; adding an oxidant to said secondary oxidation chamber to further oxidize said gasified solid organic materials; and transferring said further oxidized gasified solid organic materials out of said secondary oxidation chamber. Suitably the oxidant that is added to the primary oxidation chamber consists essentially of air or oxygen or temperature enhanced air. The oxidant added to said secondary oxidation chamber preferably also consists essentially of ambient air.

The method according to the present invention for gasifying solid organic materials to produce finished gaseous effluent and solid residue includes the steps of:

a) providing a primary oxidation chamber having a bottom portion and a converging upper portion to facilitate mixing of gaseous material in the chamber;

b) introducing solid organic materials from a source of supply into the primary oxidation chamber to provide a mass of the solid organic materials in the primary oxidation chamber;

c) heating a mass of the solid organic materials in the primary oxidation chamber;

d) adding an oxidant to the primary oxidation chamber to gasify the heated mass of solid organic materials in the primary oxidation chamber and to initiate a flow of gaseous effluent within the primary oxidation chamber;

e) establishing a gaseous flow path within a the primary oxidation chamber whereby a portion of the gaseous effluent flows in an upward direction through the heated solid organic materials to enhance continuous oxidation of the organic materials, and advancing the remaining portion of the gaseous effluent flow in a direction outward from the primary oxidation chamber; and, f) transferring the solid residue out of the primary oxidation chamber.

The method may be a continuous or intermittent method. That is, the solid organic materials may be continuously or intermittently transferred to a device to recover the thermal energy therein. Solid organic materials may be transferred to the primary gasification chamber at a predetermined or at a controllable rate to maintain a mass, which may be substantially constant, of solid organic materials in the gasification chamber. Oxidant is continuously added to the primary oxidation chamber to continuously gasify the solid organic materials in the mass. Solid residue is continuously transferred out of the gasification chamber. The oxidant may however be added to the primary oxidation chamber at a rate which is insufficient to fully oxidize the solid organic materials, in which case the method further comprising the steps of: providing a secondary oxidation chamber for receiving the remaining portion of the gaseous effluent that is transferred out of the primary oxidation chamber; transferring the effluent to another process application or adding an oxidant to the secondary oxidation chamber to further oxidize the remaining portion of the gaseous effluent into a gaseous finished effluent; and transferring the finished gaseous effluent out of the secondary oxidation chamber. The secondary oxidation chamber may be generally cylindrically shaped, the remaining portion of the gaseous effluent flowing through the secondary oxidation chamber generally parallel to a longitudinal axis of the secondary oxidation chamber. The method may include adding oxidant to the secondary oxidation chamber substantially tangentially to the secondary oxidation chamber so as to swirl the oxidant around the remaining portion of the gaseous effluent that is flowing through the secondary oxidation chamber.

In one embodiment, the oxidant that is added to the primary oxidation chamber consists essentially of ambient, heated or modified air. The oxidant that is added to the secondary oxidation chamber may consist essentially of ambient air.

The solid organic materials may be transferred into the primary oxidation chamber at a location adjacent the side of the cylinder or box. Advantageously, the method of the present invention may also include the steps of: providing an ash removal system within the primary oxidation chamber at a location in the lower portion of the cylinder or box, the ash removal system receiving the solid organic materials as the solid organic materials are transferred into the primary oxidation chamber; and maintaining the mass of the solid organic materials on the ash removal system during the oxidation of the solid organic materials in the primary oxidation chamber. The method according to the present invention may further include the steps of: sensing the elevation of the top of the mass of solid organic materials on the grate; and controlling the rate at which the solid organic materials are transferred into the primary oxidation chamber to maintain the top of the solid organic materials on the grate at a substantially constant elevation.

The method of the present invention may further include the step of periodically actuating the ash removal system to remove the non-combustible residue from the primary oxidation chamber.

The primary oxidation chamber may be vertically disposed and the solid organic materials may be transferred into the primary oxidation chamber at a location spaced along the either or both sides thereof. A part of the oxidant may be added to the primary oxidation chamber at a location adjacent the bottom portion. The second part of the oxidant may be added to the primary oxidation chamber above its bottom to gasify the heated organic materials in stages. The step of advancing the remaining portion of the gaseous effluent from the primary oxidation chamber may occur through an insulated exit duct that has a restricted entry portion to prevent the passage of flame from the primary oxidation chamber.

BRIEF DESCRIPTION OF THE DRAWINGS

The present invention will be further illustrated by way of the accompanying drawings, in which:

FIG. 5 is a flow diagram showing the process to a heat exchanger.

FIG. 13 is a graph plotting temperature vs. sensor height to determine height of fuel bed.

DETAILED DESCRIPTION OF EMBODIMENTS OF THE INVENTION

Figure 1:
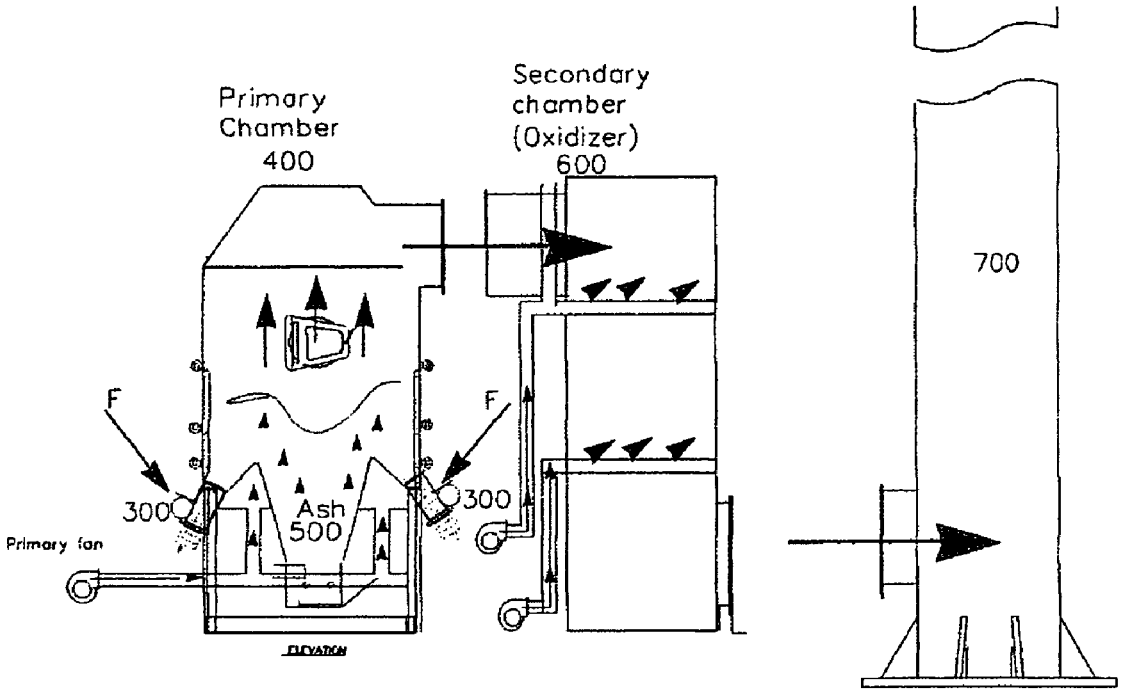
FIG. 1 is an elevation view, partially in section, of an apparatus for gasifying solid organic materials according to the present invention.

As is shown in FIG. 1, an apparatus for practicing the present invention utilizes a feed assembly, indicated generally by reference numeral 300, which is driven by a drive assembly and which feeds material from a storage hopper assembly 100 into a primary oxidation chamber 400. The inert or unburned portion of the feed material or fuel fed into primary oxidation chamber 400 is withdrawn as ash 500 and transported from chamber 400 by an ash removal system 420. In the preferred embodiment of the invention, the fuel fed into the primary oxidation chamber 400 is only partially oxidized therein, and hence there is provided a secondary oxidation chamber, indicated generally by reference numeral 600, to complete the oxidation of the partially oxidized gaseous effluent from chamber 400 after it leaves primary oxidation chamber 400. The fully oxidized gaseous effluent from secondary oxidation chamber 600 may be used as a source of heat energy in a device or process which requires heat energy. In the preferred embodiment of the present invention this may take place between the second oxidization chamber 600 and the stack 700.

The material which is to be oxidized is delivered to storage hopper assembly 100 in any suitable manner, for example, manually from a pile of such material or by means of a conveyor, not shown, from a self-unloading truck body of an appropriate type, also not shown, or in any other suitable manner.

The feed material which is delivered into the storage hopper assembly may be any of the wide range of solid, organic materials of a type which is frequently referred to as "biomass" materials, and suitable materials of this type include wood chips, sawdust, corn cobs, and bagasse. These materials are usually waste by-product materials from various agricultural or forest-based industrial processes, and contain substantial amounts of chemical energy that is capable of being converted to thermal energy by suitable oxidation processes. Such materials are, however, difficult to handle because they are usually moist and are non uniform or irregular in shape, and heretofore it has been difficult to efficiently and effectively oxidize such materials because of their high moisture content, their non uniform chemical composition, and their frequent contamination with non-reacting materials, such as sand, dirt, rocks and stones.

Figure 1B:
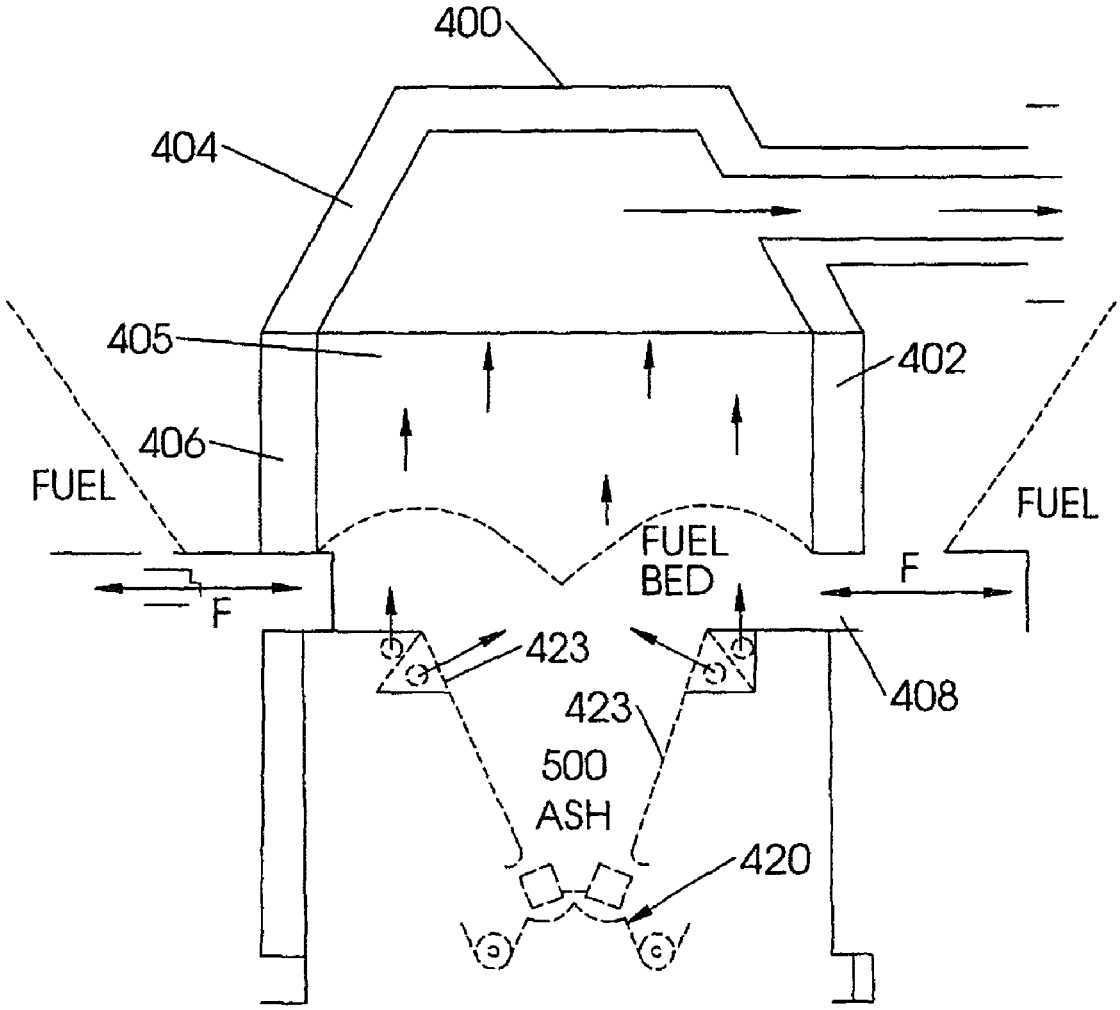
FIG. 1*b* shows an alternate side feed method.
Figure 2:
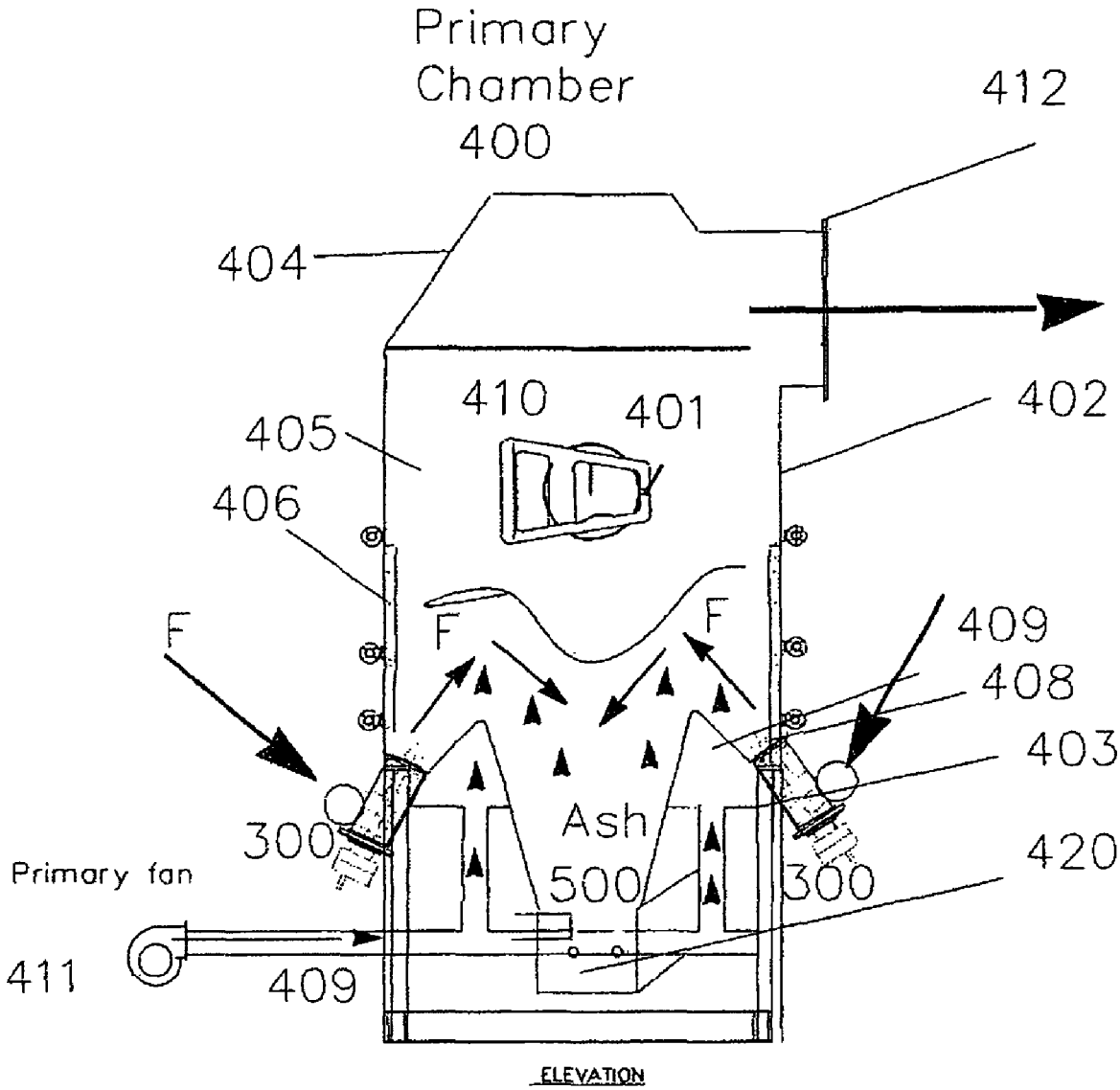
FIG. 2 is a fragmentary elevation view, in section, of a portion of the apparatus depicted in FIG. 1 showing the primary chamber.
Figure 3:
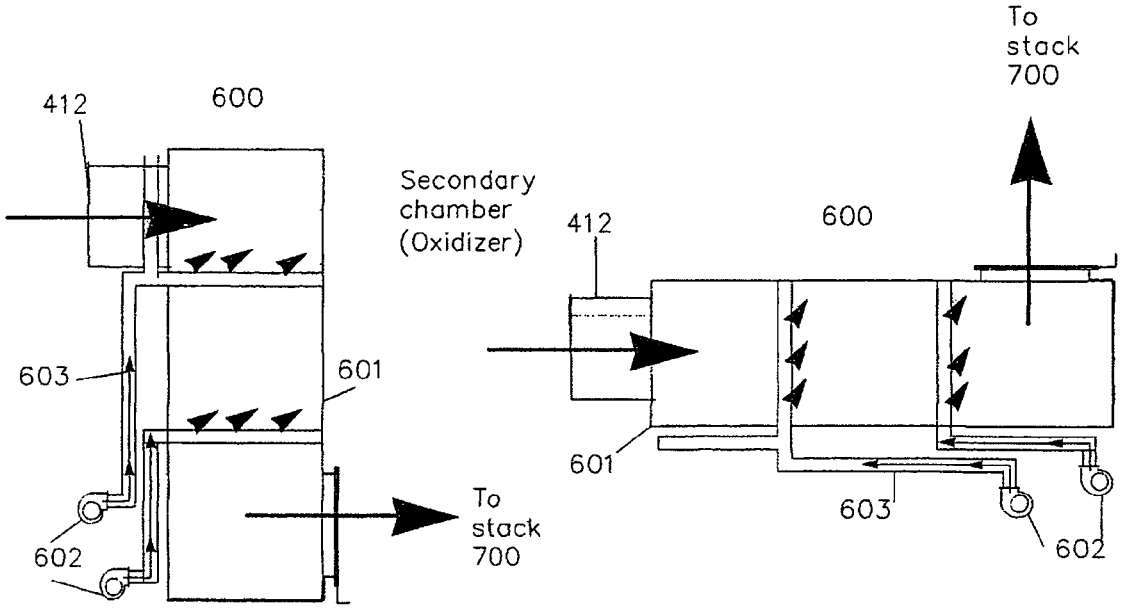
FIG. 3 is a fragmentary elevation view, in section, of a portion of the apparatus depicted in FIG. 1; Oxidizer.
Figure 4:
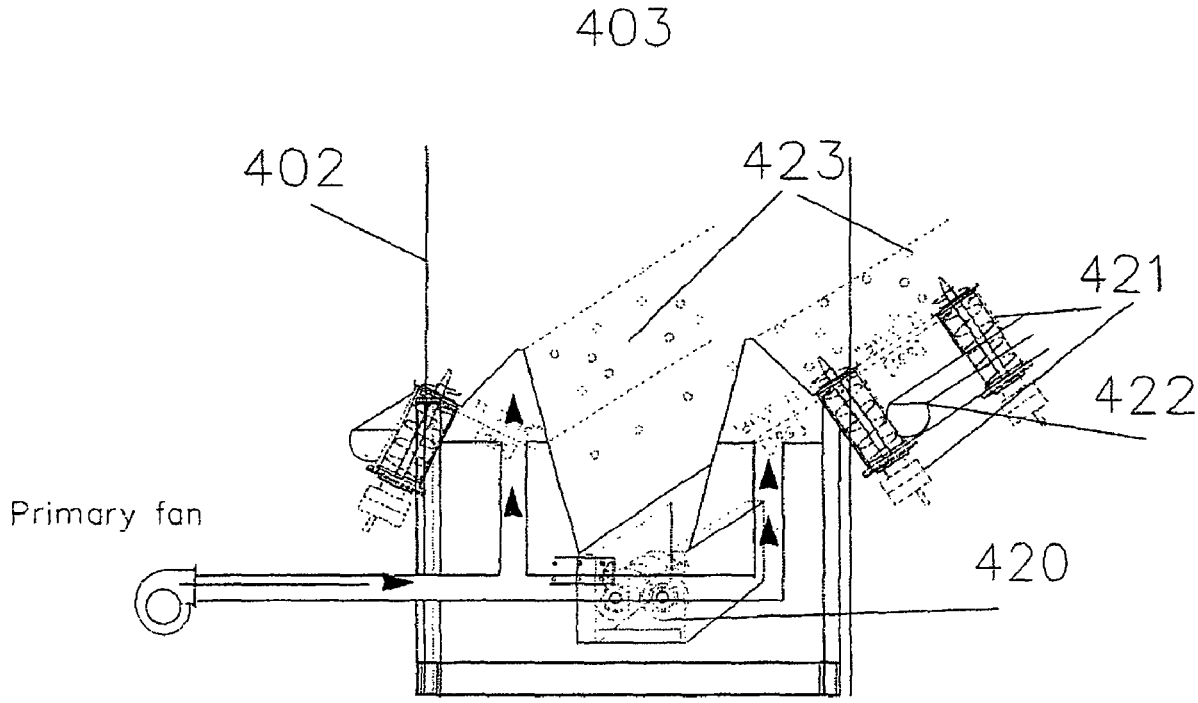
FIG. 4 is a more detailed view of the floor and feed system.
Figure 4B:
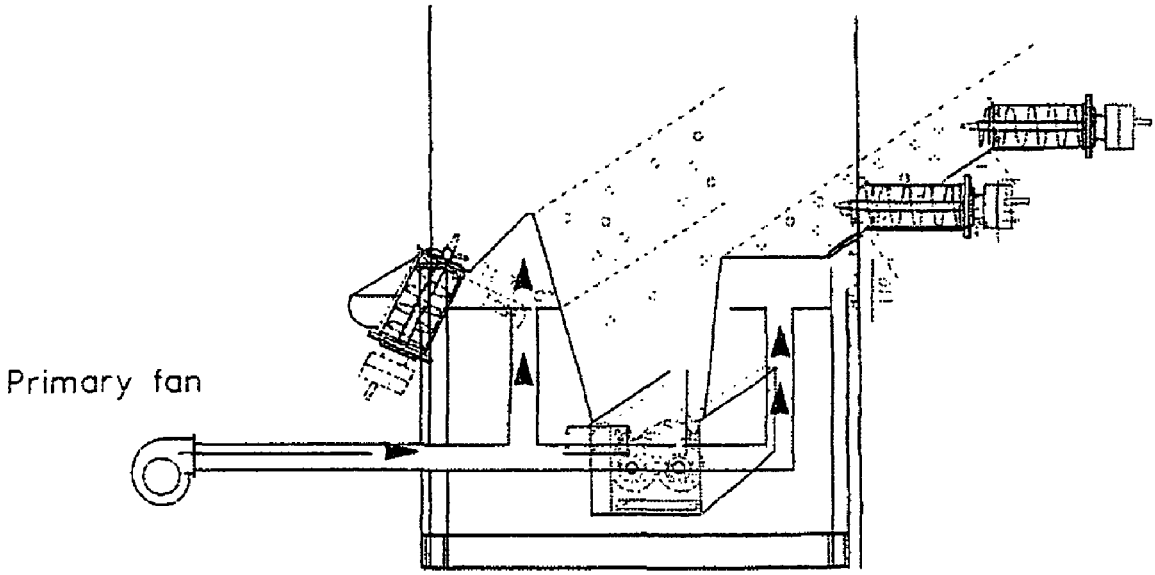
FIG. 4*b* shows an alternative feed for the same floor.
Figure 6:
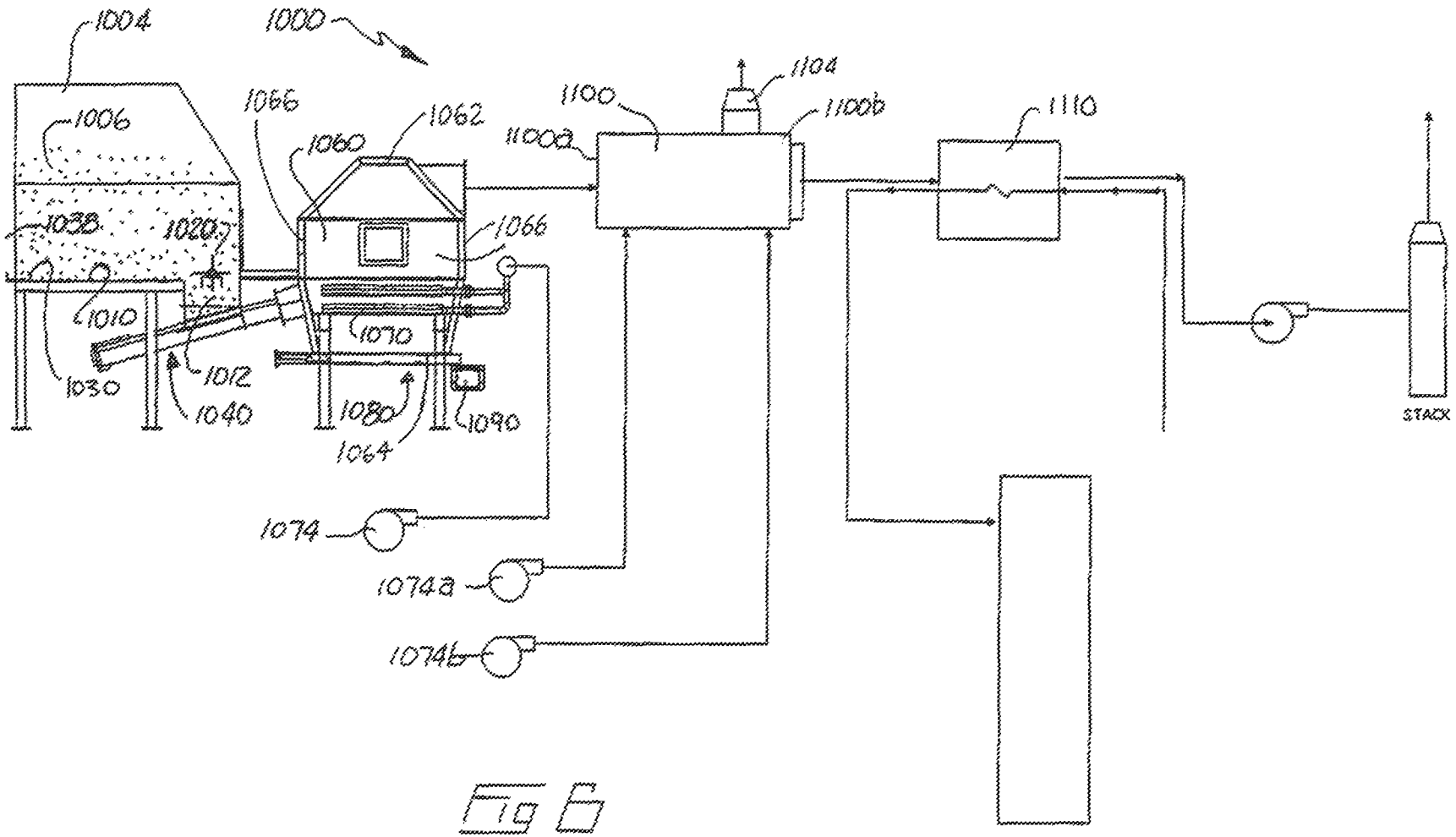
FIG. 6, is a schematic flow diagram illustrating a typical process.
Figure 7:
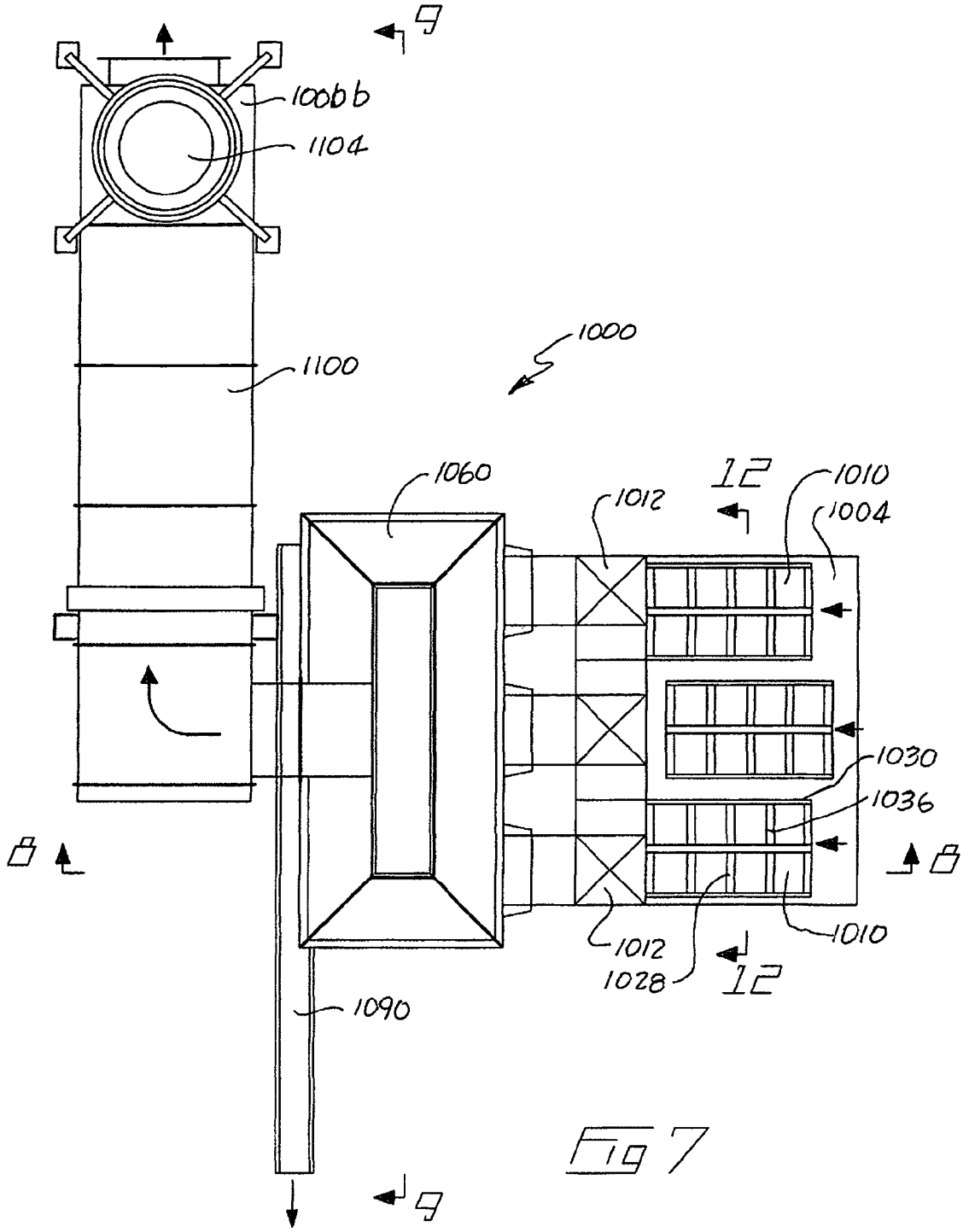
FIG. 7 is a plan view of the gasifier of the present invention illustrating infeed and oxidizer.

FIG. 1*b* shows a different fuel delivery process.

As noted above, the feed material delivered in direction F from storage hopper assembly 100 is oxidized to a gaseous state in the primary oxidation chamber 400, preferably to a state which is not fully oxidized. The primary oxidation chamber 400 has a chamber 402 which is defined by wall 401 surrounding a vertically extending cylinder or box. Chamber 402 rests on a floor 403. Box 402 is open at its top. A downwardly facing hemispherical dome or angled roof 404 is mounted over the open top of chamber 402. Wall 401 has a multiplicity of layers. The innermost layer 405 is a layer of a high-temperature refractory material that is capable of withstanding the elevated temperatures that will develop within the primary oxidation chamber 400, for example, temperatures in the range of approximately 2300° F. to approximately 2500° F. Wall 402 is thus capable of allowing the oxidation of the biomass feed material that is developed in the primary oxidation chamber 400 while maintaining a tolerable skin temperature on the outside of the wall. In particular, wall 401 may include an insulating layer 406 mounted behind the innermost layer 405 to reduce a loss of heat through wall 401. The insulating layer 406 may be a single layer of a suitable insulating material, for example, insulating brick or insulating fire brick, or it may be made up of a multiplicity of layers of similar or dissimilar insulating material if it is desired to minimize the transfer of heat through the wall 401 to a degree that cannot be accomplished in a satisfactory manner by means of a single layer of insulating material, all of which is known in the art. The multiplicity of layers in wall 401 may advantageously include a structural layer 407 of sheet metal, for example, plate steel, to provide strength and rigidity for the primary oxidation chamber 400.

The biomass feed material from the storage hopper assembly is introduced into the primary oxidation chamber 400 through an opening 408 in the side of wall 401 or in floor 403 of the primary oxidation chamber 400. An annular distributor 409 forms part of the floor 403. Feed material is introduced upwardly through opening 408 and annular distributor 409 by means of a feed assembly 300. During normal operating conditions, as is illustrated in FIG. 5, the feed material rises in direction G over the top lip of the annular distributor 409 and rests on ash 500, until it forms a mass M of such material. This is the normal equilibrium condition of the primary oxidation chamber 400 when it is operational.

To bring the primary oxidation chamber 400 to an operational condition on start up, the feed assembly 300 is activated to develop a mass of feed material on the ash removal system 420. The mass of feed material is then ignited, for example manually or by a pilot burner. A removable wall portion 401*a* of wall 401 of is removable from the remaining portion of wall 401 to facilitate the igniting of the mass of unlit feed material, and to permit the inspection and/or cleaning out of chamber 402. The removable portion 401*a* may be mounted on a swing-out arm assembly (door) 410 to facilitate the removal of the removable portion 401*a* of wall 401.

The oxidation of the feed material in the primary oxidation chamber 400 requires a source of oxygen. Ambient air has been found to be a suitable source of oxygen for this purpose. An air blower 411 provides ambient air to the primary oxidation chamber 400. Blower 411 introduces ambient air in direction H into the interior of the mass of feed material through annular distributor 409.

Un-oxidized feed material or fuel 302 is driven by feed assembly 300 in direction G up into mass M. Feed material 302 moves from the bottom to the top of mass M, and heats as it moves upwardly. As it heats, volatile ingredients in fuel 302 begin to gasify and dissipate. Gasified volatile ingredients are drawn away by an induction fan or by the natural draw of a stack down-stream from the gasifier. Air from the blower 411 is forced upwardly through fuel 302. As fuel 302 in mass M loses more and more of its volatile ingredients as they gasify, fuel 302 becomes char and eventually ash. This happens progressively as fuel 302 is exposed to the full operating temperature inside the primary oxidation chamber 400 and more air, at which time all of the volatile ingredients such as the organic constituents of the fuel gasify and pass in direction I from the primary oxidation chamber 400 as an incompletely oxidized gaseous effluent E, gaseous effluent E leaving the primary oxidation chamber 400 through an insulated exit duct 412.

The oxidation of fuel 302 in mass M proceeds more satisfactorily if the amount of feed material in mass M is maintained at relatively constant. To accomplish this, a reciprocal probe 414 is mounted in wall 401 so as to extend downwardly into primary oxidation chamber 400 through wall 401 to determine the elevation of the top of the feed material in mass M. Suitable instrumentation, not shown, is provided to control the rate of the delivery of the feed material into the primary oxidation chamber 400 by the feed assembly 300 as a function of the elevation of the top of the feed material in mass M, as measured by the reciprocal probe 414, to maintain a substantially constant elevation of the top surface of mass M, and thereby to contain the mass of mass M at the substantially constant value. The reciprocal probe 414 is preferably internally cooled, by circulating air or water, to permit it to function satisfactorily in the high temperature environment of the primary oxidation chamber 400.

The air which is added to the primary oxidation chamber 400 through the annular distributor 409 appears to flow up through mass M. This continuous flow of air progressively changes in composition as fuel 302 is gasified and oxidized so as to include gaseous oxidized feed material. The hemispherical shape of the dome facilitates the quality and mixing of effluent E.

When the gaseous effluent E leaving the primary oxidation chamber 400 through the insulated exit duct 412 is not being used for other application, it passes into secondary oxidation chamber 600. Secondary oxidation chamber 600 may advantageously be in the form of a cylinder having insulated walls 601 and whose longitudinal axis D is coextensive with the longitudinal axis of insulated exit duct 412 of the primary oxidation chamber 400. A secondary oxidant is added to the secondary oxidation chamber 600 to burn or completely oxidize effluent E flowing into the secondary oxidation chamber through the insulated exit duct 412 from the primary oxidation chamber 400. Again, ambient air is satisfactory for use as the secondary oxidant and may be provided to the secondary oxidation chamber 600 by means of a second blower 602, again of conventional construction. Preferably the blower 602 is arranged with its outlet 603 entering the secondary oxidation chamber 600 in a direction C which is tangential to walls 601. Sufficient air is added to the secondary oxidation chamber 600 by means of second blower 602 to fully oxidize the partially oxidized gaseous materials in effluent E entering the secondary oxidation chamber 600 from the insulated exit duct 412 of the primary oxidation chamber 400. Preferably, excess air is forced in to secondary oxidation chamber 600 to ensure complete reaction and to prevent excessively high temperatures from developing therein.

In the preferred operation of the apparatus according to one embodiment of the present invention, and without intending to be limiting, the temperature in the secondary oxidation chamber 600 should be limited to approximately 2800° F. This may be accomplished by utilizing air forced in to the system, including the air blown in to the primary oxidation chamber 400 by the air blower 411 and the air blown in to the secondary oxidation chamber 600 by the second blower 602. For example, the total volume and flow rate of air forced into both chambers 400 and 600 may equal approximately 150% of that required for full oxidation of the volume of fuel 302 added to the primary oxidation chamber 400. The fully oxidized, high-temperature gaseous material from the secondary oxidation chamber 600 exits from the secondary oxidation chamber 600 as an effluent B through a second insulated duct 606 and passes into a energy recovery system such as heat exchanger 800 or into an exhaust stack 700.

Ash removal system 420 is mounted under primary oxidation chamber 400 and includes a continuous or intermittent operating auger or hydraulic ram system. Ash removal system 420 may be mounted as part of floor 403. Feed assembly 300 includes one or more angled feed augers 321 or hydraulic rams (not shown), fed by one or more horizontal augers 322 that bring fuel 302 in direction F to the feed augers 321. An angled and perforated air bed 411 which forms the upper surfaces on distributor 409 allows air flowing in direction H to mix with the fuel 302 in mass M so as to form the proper fuel bed. Nonoxidizable materials which were in the original feed material 302 normally work their way to the bottom of mass M as ash 500 as the oxidation process continues. Ash 500 exits from the primary oxidation chamber 400 through the ash removal system 420 by means of augers 421 mounted below so as to remove ash falling in direction A through a central aperture 422 formed between and under the sloped inner surfaces of airbed 411. A storage hopper assembly or conveyor (not shown) is attached to the ash removal system 420 for removal of material from the primary chamber 400.

While the invention has been described in reference to the use of the heat produced thereby to heat water in a water tube boiler or heat exchanger 800, the heat produced by the invention can also be used in other ways, for example, in the generation of electricity or the use of the effluent from the primary chamber in other processes.

A further embodiment 1000 of the present invention for gasifying materials such as the organic biomass by-products of logging and farming industry, is further illustrated within the accompanying drawings, FIGS. 6 through 12.

Embodiment 1000, may generally include a storage container 1004, into which solid organic by-products or other biomass fuel 1006 such as wood chips, hog fuel (bark mulch), slaughter-house waste etc. can be loaded.

A walking floor 1010 within container 1004 moves such fuel toward a discharge port 1012. Discharge port 1012 may contain an agitator 1020 or like mechanism for breaking up compacted fuel.

Walking floor 1010 has a lower stationary component 1024 containing a plurality of upstanding, transversely positioned fixed baffles 1028 and a reciprocally movable component 1030 also containing upstanding baffles 1036 which are positioned intermediately of the fixed baffles 1028 on stationary component 1024. Reciprocally movable component 1030 is operated by way of example, a hydraulic ram 1038.

A fuel delivery mechanism 1040 is positioned below discharge port 1012 of container 1004. Fuel 1006 falls from agitator 1020 through discharge port 1012 into the fuel delivery mechanism 1040. Fuel delivery mechanism 1040 is in a preferred form a hydraulic ram 1044.

Fuel dropping through discharge port 1012 falls into the breech 1048 of fuel delivery mechanism 1040. Ram 1044 drives fuel 1006 from breech 1044 into a compression tube 1050. Successive strokes of ram 1044 drive discrete slugs 1054 of fuel into a diverging chute or diffuser 1058. Both tube 1050 and diffuser 1058 are lined with fireproof refractory material such as heat resistant brick or concrete. The compacted fuel slugs 1054 within compression tube 1050 inhibit a fuel back-burn toward fuel storage container 1004.

Fuel is thus continuously supplied from container 1004 to primary oxidation chamber 1060 having a top 1062, a bottom 1064 and sides 1066. Fuel delivery system 1040 may have a capability of delivering such fuel to primary oxidation chamber 1060 at 500 lbs/hr. although this is not intended to be limiting.

Figure 9:
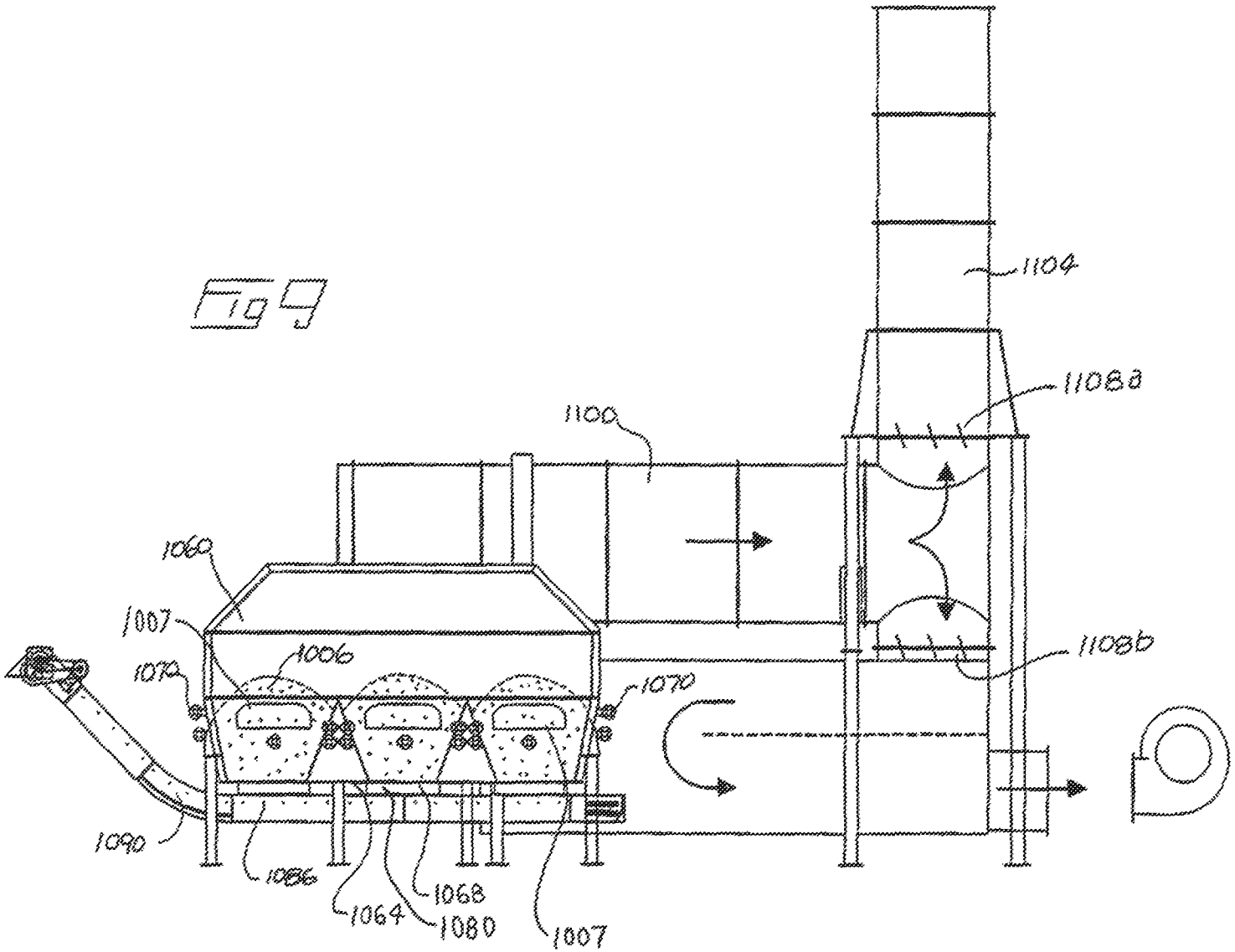
FIG. 9 is a sectional view taken on line 9-9 of FIG. 7.
Figure 9D:
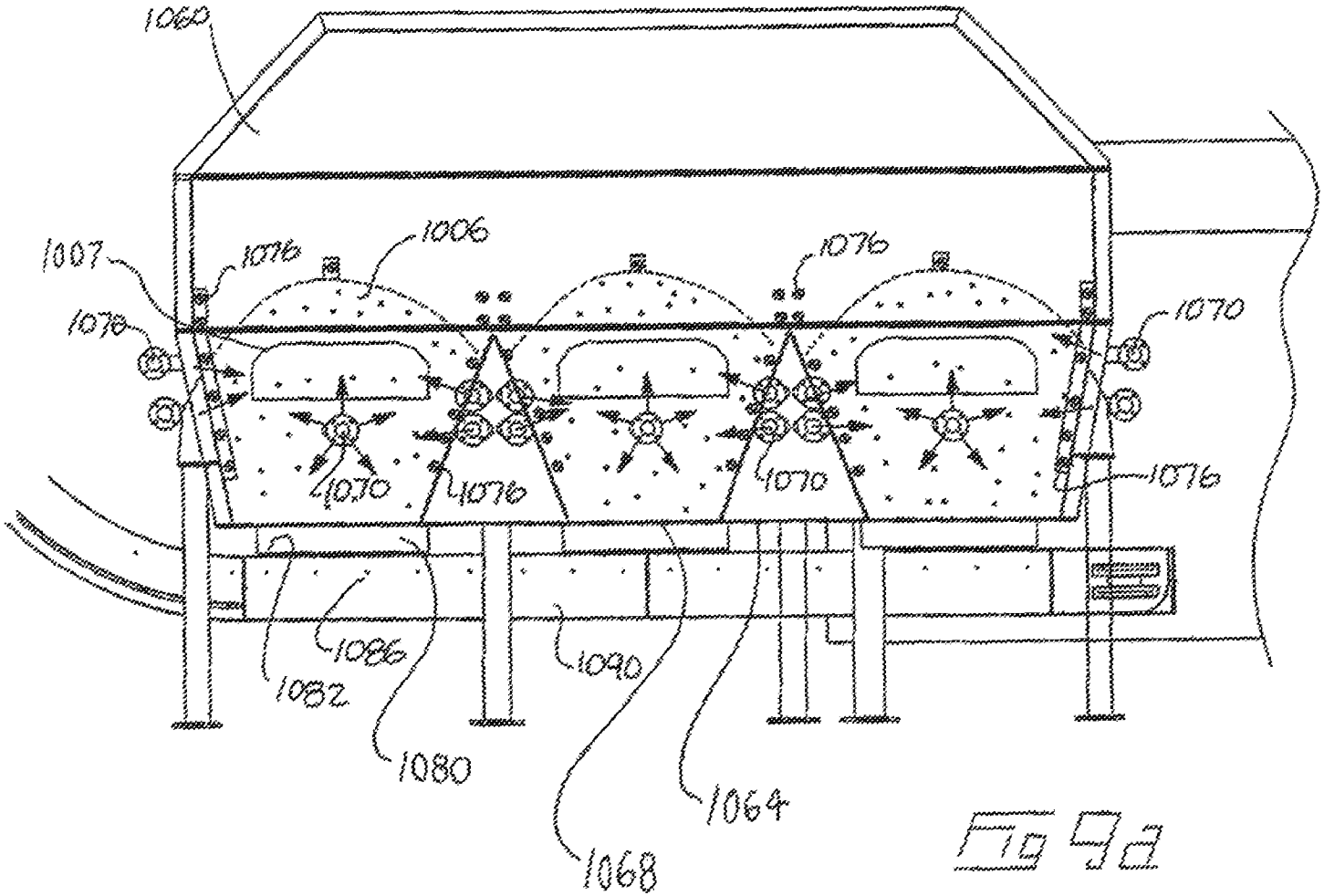
FIG. 9*a* is an enlarged view of the gasifier illustrated in FIG. 9.
Figure 10:
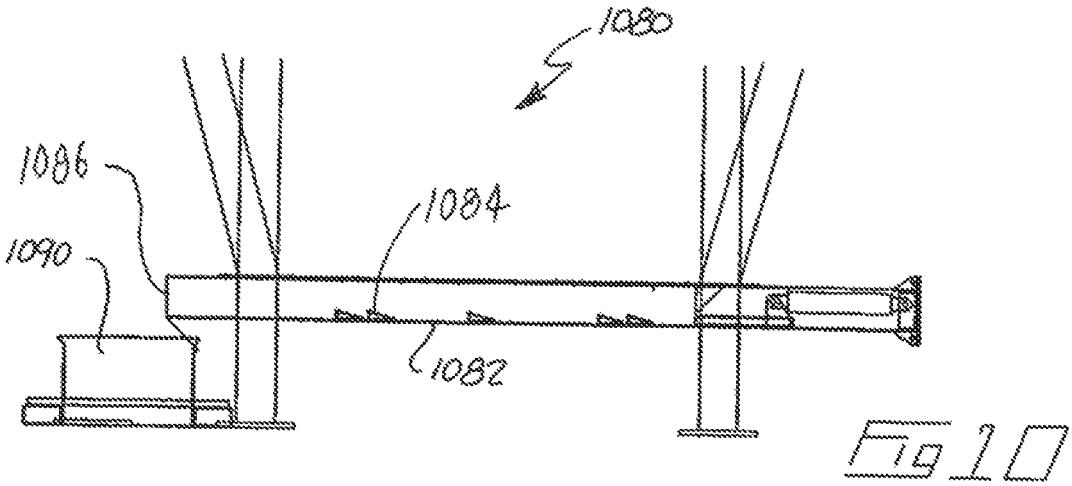
FIG. 10 is an enlarged view of the walking floor.
Figure 11:
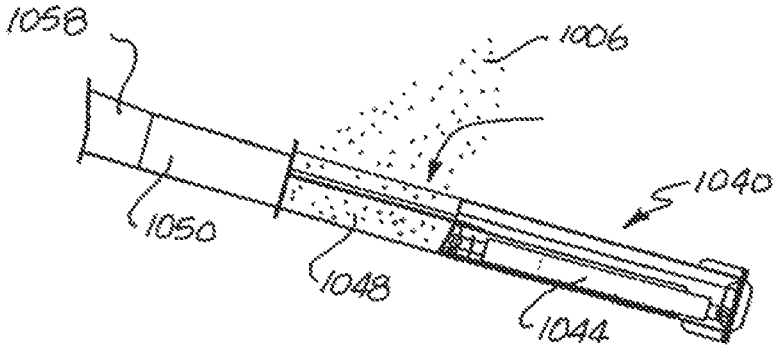
FIG. 11 is an enlarged view of the fuel infeed mechanism.
Figure 11A:
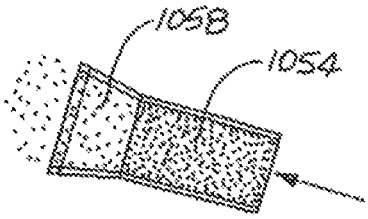
FIG. 11*a* is an enlarged plan view of the compression chute and diffuser of fuel infeed mechanism.
Figure 12:
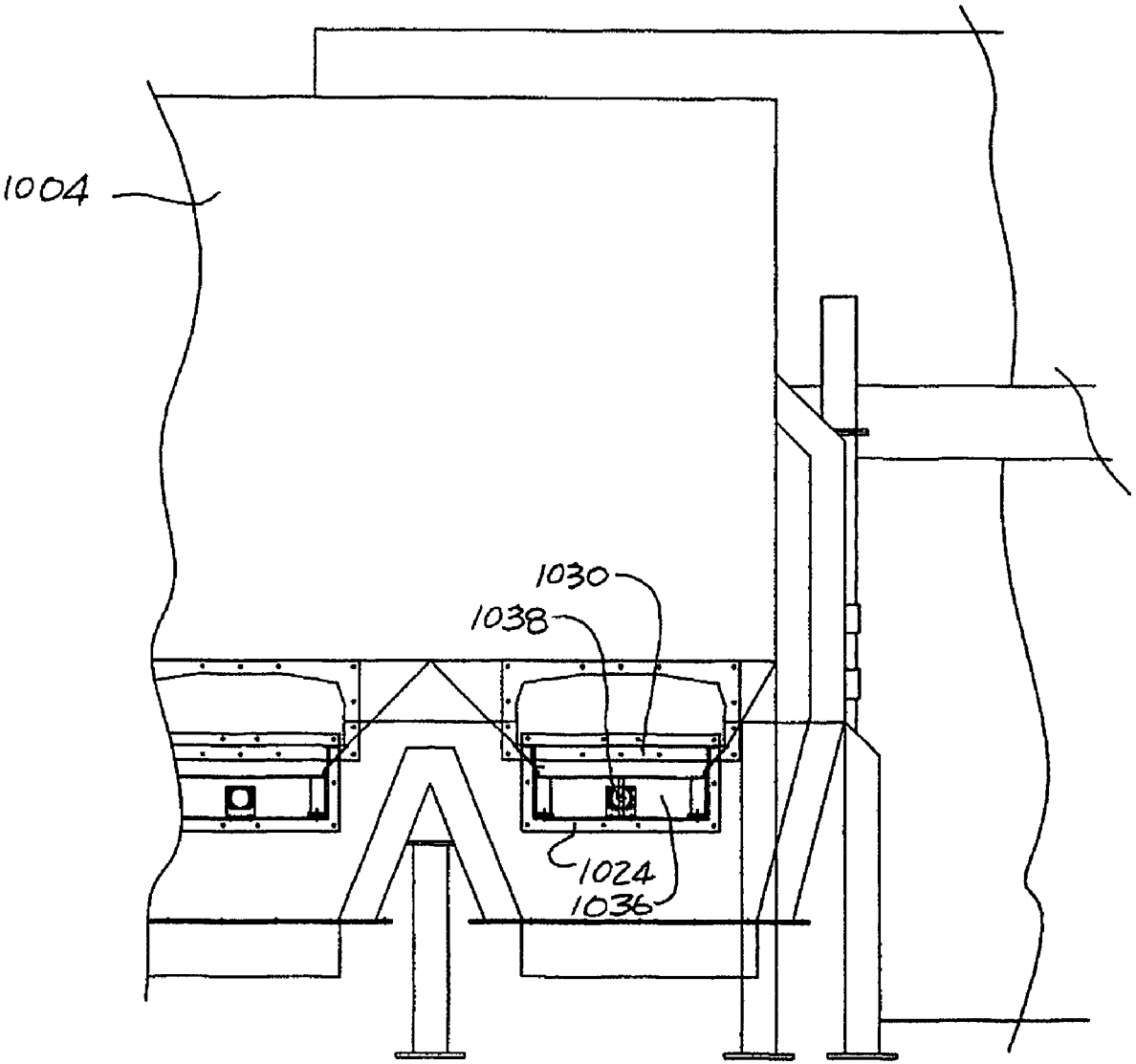
FIG. 12 is a sectional view taken on line 12-12 of FIG. 7.
Figure 15:
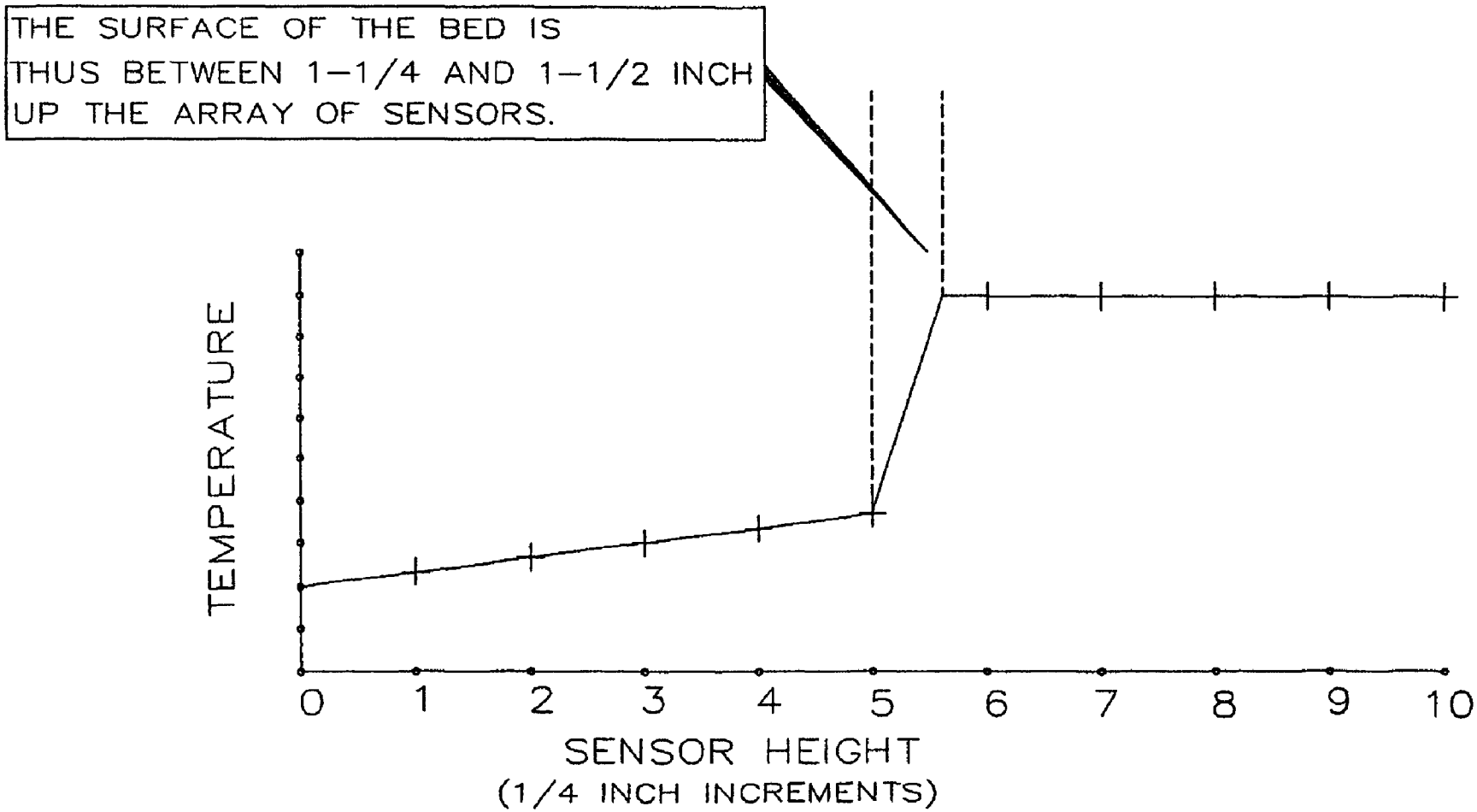

Fuel delivery mechanism 1040 in a preferred form is upwardly inclined with respect to primary oxidation chamber 1060 so that fuel discharging from diffuser 1058 is driven upwardly through an inlet opening 1007 into chamber 1060, forming a mounded fuel bed having a convex upper surface as illustrated in FIG. 9.

Figure 8:
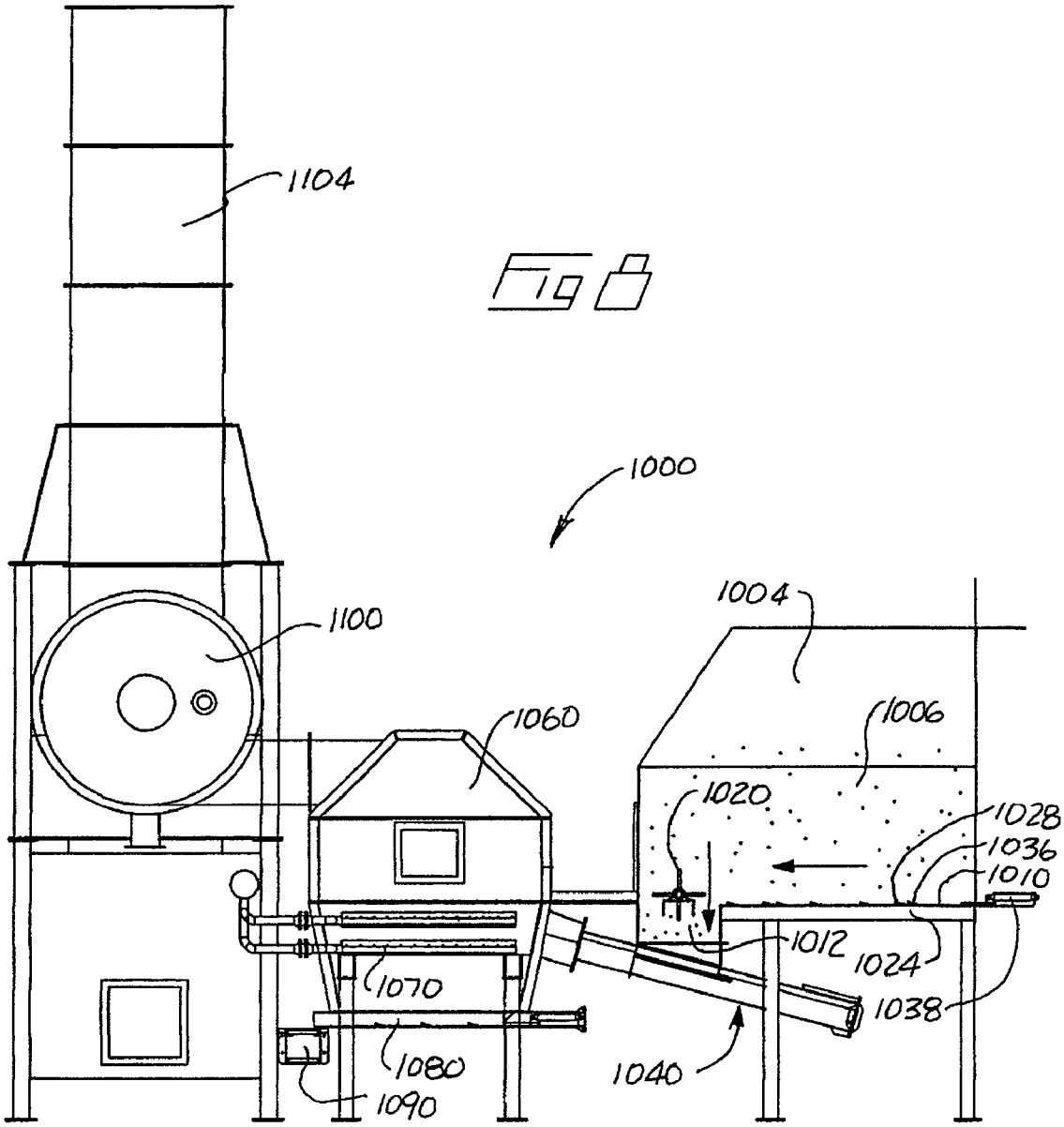
FIG. 8 is a sectional view taken on line 8-8 of FIG. 7.

An oxidant; for example, in the form of ambient air is introduced into primary oxidation chamber 1060, generally below the surface of fuel 1006, through a plurality of perforated conduits 1070. As shown in FIGS. 8, 9 and 9*a*, the perforated conduits extend longitudinally into the primary oxidation chamber 1060 in spaced separation from one another, with at least one perforated conduit, preferably in the form of an elongated cylindrical tube, positioned above and in spaced separation from the open bottom of the oxidation chamber such that it is embedded within the fuel 1006 once the primary oxidation chamber 1060 has been filled with fuel 1006 fed into primary oxidation chamber by the fuel delivery mechanism 1040. Blower 1074 provides air at a rate of 944.4 lb/hr although this is not intended to be limiting.

Heat sensors 1076 positioned within chamber 1060 may be coupled to processor means known in the art which regulate both the volume of fuel and ambient air delivery to chamber 1060 to maintain the level of the fuel bed and the temperature of the outflow to the secondary oxidation chamber 1100.

An ash removal system 1080 is positioned beneath primary oxidation chamber 1060 and generally comprises a walking floor 1082 having upstanding baffles 1084 and a conveyor 1090. Ash 1086 at a rate of 1.9 lb/hr, although this is not intended to be limiting, falling through an opening 1068 in the bottom 1064 of the primary oxidation chamber 1060 onto walking floor 1082 where its reciprocating action causes the ash 1086 to be moved in a direction from the side of the primary oxidation chamber having inlet opening 1007 through exit opening 1086 and onto a conveyor 1090 for immediate removal and subsequent disposal.

A secondary oxidation chamber 1100 positioned downstream and in fluid communication with primary chamber 1060 receives a high carbon gaseous effluent from primary chamber 1060. An oxidant which again may be in the form of ambient air is introduced into chamber 1100 near the upstream end 1100*a* by blower 1074*a* at a rate of 5661.6 lb/hr, not intended to be limiting, to produce secondary oxidation temperatures generally in the range of 2000 Deg. Fahrenheit, although such temperature is not intended to be limiting.

Ambient air is introduced onto secondary oxidation chamber 1100, near downstream end 1000*b*, by blower 1074*b* at a rate of 738 lb/hr to thus reduce secondary oxidation temperatures to approximately 1600 Deg. Fahrenheit. Although, as stated previously, such rate and temperature are not intended to be limiting.

An exhaust stack 1104 positioned near the downstream end 1100*b* of secondary oxidation chamber 1100 further regulates the internal temperature of air within chamber 1100.

For example, louvers 1108*a* and 1108*b* mounted within chamber 1100 in proximity to exhaust stack 1104 may generally be remotely operated in accordance with instructions for the processing means in response to temperature data from heat sensors located, by way of example, in secondary oxidation chamber 1100 near ends 1100*a* and 1100*b* or within a remote facility such as a heat exchanger or dry kiln 1110.

Should the temperature sensing mechanism with the heat exchanger or dry kiln 1110, for example, determine that incoming heated air is below an optimal temperature, louvers 1108*a* are actuated to restrict air flow outwardly of stack 1104 while louvers 1108*b* are simultaneously actuated to permit a greater volume of heated air to be discharged from the downstream end 1100*b* of secondary oxidation chamber 1100.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for gasifying solid fuel, said solid fuel including solid organic materials comprising:

a primary oxidation chamber defined by a top, a bottom and sides, and having an inner surface lined with a refractory material to promote catalytic oxidation of the solid organic materials;

at least one inlet opening in one of said sides for infeed of said solid fuel into said primary oxidation chamber;

a storage container for storing the solid fuel;

transfer means connecting said storage container with said at least one inlet opening and for transferring in an upwardly inclined direction the solid fuel from said means for storing the solid fuel through said inlet opening into said primary oxidation chamber to form an upwardly mounted fuel bed of the solid fuel including the organic materials on said bottom of said primary oxidation chamber, wherein said transfer means includes a hydraulic ram feeder and a compression tube, said hydraulic ram feeder driving fuel from said means for storing the solid fuel into said compression tube thereby compacting said fuel;

means for supplying an oxidant into said primary oxidation chamber to gasify the solid organic materials to produce gasified organic materials including a first gaseous effluent, thereby leaving a residue of said solid fuel;

cooperating with the primary oxidation chamber, a means for removing said first gaseous effluent from said primary oxidation chamber;

at least one opening in said bottom of said primary oxidation chamber, said at least one opening having mounted thereunder means for the removal of said residue, said means for the removal of said residue includes a walking-floor feeder wherein a reciprocating rack having upstanding rigid members is seated on, and slides reciprocally relative to, said bottom so as to urge said residue out from underneath said fuel bed; and wherein said reciprocating rack reciprocating linearly from a first position adjacent a first side of said primary oxidation chamber to a second position away from said first side.

2. The apparatus of claim 1 wherein when in said second position, said reciprocating floor extending out through an opening in a second side of said primary oxidation chamber, said second side being opposite said first side.

3. The apparatus of claim 2 wherein said transfer means further includes a fuel removal means for removing the fuel from said storage means and for transferring the fuel to said hydraulic ram feeder adjacent said inlet opening of said primary oxidation chamber.

4. The apparatus of claim 3 wherein said transfer means further includes a diverging chute connected at a narrower end to said compression tube, and at an opposite, diverging end to said inlet opening, compacted fuel from said compression tube being driven into and through said diverging chute and into said primary oxidation chamber by said hydraulic ram feeder.

5. The apparatus of claim 4 wherein said compression tube and said diverging tube being lined with refractory material.

6. The apparatus of claim 1 further comprising a plurality of perforated air distribution conduits for supplying an oxidant into said fuel bed to gasify the solid organic materials to produce gasified organic materials including a first gaseous effluent from the fuel bed, thereby leaving a residue of said fuel.

7. The apparatus of claim 6 wherein said plurality of individually spaced perforated air distribution conduits extending longitudinally across a fuel bed cavity in said primary oxidation chamber, at least one of said plurality of perforated air distribution conduits positioned above and in spaced separation from the bottom of said fuel bed cavity and through said fuel bed, adjacent to fuel driven upwardly into said fuel bed through said inlet opening, so as to introduce air into said interior of said fuel bed to thereby promote evenly distributed gasification, evenly distributed through said fuel bed.

8. The apparatus of claim 7 wherein said at least one of said plurality of perforated air distribution conduits being positioned below said inlet opening.

* * * * *

UNITED STATES PATENT AND TRADEMARK OFFICE

CERTIFICATE OF CORRECTION

PATENT NO. : 7,793,601 B2
APPLICATION NO. : 11/285145
DATED : September 14, 2010
INVENTOR(S) : Kenneth Davison, Neal Stroulger and Dave Berner It is certified that error appears in the above-identified patent and that said Letters Patent is hereby corrected as shown below:

Title Page, item (76) should be corrected to read as follows:

(76) Kenneth Davison, 10283 Monte Bella Road, Lake Country, British Columbia (CA) V4V 1K7; Neal Stroulger, 4336 Stevenson Road, Camloops, British Columbia (CA) V2H 1S8; -- Dave Berner, 9 Leyland Close, Spruce Grove, Alberta, (CA) --.

Signed and Sealed this
Twenty-sixth Day of April, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,793,601 B2
APPLICATION NO. : 11/285145
DATED : September 14, 2010
INVENTOR(S) : Kenneth Davison, Neal Stroulger and Dave Berner It is certified that error appears in the above-identified patent and that said Letters Patent is hereby corrected as shown below:

Title Page, item (76) should be corrected to read as follows:

(76) Kenneth Davison, 10283 Monte Bella Road, Lake Country, British Columbia (CA) V4V 1K7; Neal Stroulger, 4336 Stevenson Road, Kamloops, British Columbia (CA) V2H 1S8; -- Dave Berner, 9 Leyland Close, Spruce Grove, Alberta, (CA) --.

This certificate supersedes the Certificate of Correction issued April 26, 2011.

Signed and Sealed this
Fourteenth Day of June, 2011

David J. Kappos

David J. Kappos
*Director of the United States Patent and Trademark Office*